US005429177A

United States Patent [19]

Yaron et al.

[11] Patent Number: 5,429,177

[45] Date of Patent: Jul. 4, 1995

[54] FOIL REGENERATOR

[75] Inventors: Ran Yaron, Palo Alto; Matthew P. Mitchell, Berkeley, both of Calif.

[73] Assignee: Sierra Regenators, Inc., Berkeley, Calif.

[21] Appl. No.: 87,894

[22] Filed: Jul. 9, 1993

[51] Int. Cl.[6] ..... F28D 17/02

[52] U.S. Cl. ..... 165/10; 62/6

[58] Field of Search ..... 165/4, 10; 62/6

[56] References Cited

U.S. PATENT DOCUMENTS

| | | | |
|---|---|---|---|
| 1,808,921 | 6/1931 | Frankl . | |
| 3,367,406 | 2/1968 | Vonb et al. | 165/10 |
| 3,397,738 | 8/1968 | Daunt | 62/6 |
| 4,386,505 | 6/1983 | Little . | |
| 4,392,362 | 7/1983 | Little . | |
| 4,489,570 | 12/1984 | Little . | |
| 4,516,632 | 5/1985 | Swift et al. . | |
| 4,619,112 | 10/1986 | Colgate . | |
| 4,651,808 | 3/1987 | Mizuno | 165/4 |
| 4,959,275 | 9/1990 | Iguchi et al. . | |
| 4,993,487 | 2/1991 | Niggemann . | |

FOREIGN PATENT DOCUMENTS

| | | | |
|---|---|---|---|
| 1324372 | 3/1963 | France | 165/10 |

OTHER PUBLICATIONS

Cryocoolers, Plenum Press, New York & London, 1983, p. 53.

Heat Transfer, Sixth Edition, McGraw-Hill, J. P. Holman, 1986, pp. 275-276.

22nd Intersociety Energy Conversion Engineering Conference, vol. 4 of 4, Aug., 1987, "A 90 CM3 Inverted Yoke Drive Sirling Engine", A. Ross., pp. 1828-1830.

Proceedings of the 23rd Intersociety Energy Conversion Engineering Conference, vol. 1, 1988, "Completion and Testing of a 90 CM3 Stirling Engine", A. Ross, pp. 97-99.

Compact Heat Exchangers, Third Edition, 1984, McGraw-Hill, W. Kays et al, pp. 76-77, 120-121, 148-149.

Advances in Cryogenic Engineering, vol. 37, Part B, "Measurement of the Performance of a Spiral Wound Polyimide Regenerator in a Pulse Tube Refrigerator", W. Rawlins et al, pp. 947-953, 1992.

Third Cryocooler Conference, Sep. 1984, "A Simple, First Step to the Optimization of Regenerator Geometry", R. Radebaugh et al, pp. A3-A24.

Cryogenics, May 1983, "Measurement of Friction Factors for the Flow of Gases in Very Fine Channels Used for Microminiature Joule-Thomson Refrigerators", Peiyi Wu et al, pp. 273-277.

Cryogenics, Aug. 1984, "Measurement of the Heat Transfer Characteristics of Gas Flow in Fine Channel Heat Exchangers Used for Microminiature Refrigerators", Peiyi Wu et al, pp. 415-420.

*Primary Examiner*—Stephen M. Hepperle

*Attorney, Agent, or Firm*—Limbach & Limbach

[57] ABSTRACT

This invention relates to compact, high efficiency foil regenerators for use in regenerative gas cycle (e.g. Stirling cycle, Ericsson cycle, Vuilleumier cycle, Gifford-McMahon cycle, Sibling Cycle and similar) cryocoolers, heat engines, refrigerators and heat pumps. Very thin foil us formed in patterns of slits and slots that produce highly efficient regenerators when the foil is stacked in layers as by rolling it upon itself.

50 Claims, 10 Drawing Sheets

FOIL REGENERATOR

BACKGROUND OF THE INVENTION

The present regenerator is usable in Stirling, pulse tube, Gifford-McMahon and Sibling Cycle cryocoolers.

Regenerative cryocoolers are required for a variety of applications in aircraft and spacecraft. These include linear Stirling cycle and linear drive Pulse Tube. Reliability and efficiency are critical considerations. Cost effectiveness is also important. Current regenerator technology for cryocoolers operating above about 50° Kelvin (K.) is based upon stacks of screens woven from stainless steel wire. Packed lead spheres are commonly used for lower temperature.

Stacked screens have advantages and disadvantages. Much of the analysis of known devices and methods as set forth herein, including identifying advantages/-disadvantages and their causes, is a part of the present invention and not prior art. Among the advantages are good heat transfer transverse to the fluid flow and poor heat transfer parallel to fluid flow. The disadvantages are several:

(1) Because heat transfer between fluid and mesh occurs mostly in the exposed portions of the wire between intersections of the wires, much of the surface area of the wire does not take part in heat transfer;

(2) Because stainless steel has relatively poor heat conductivity, the thermal mass of the wire at the intersections does not participate usefully in the regenerative process.

(3) Pressure drop through the regenerator depends upon the way in which the stacked screens match up with each other in the stack. It is possible for two screens to interlock in such a way as to seriously inhibit flow; variations in pressure drop of as much as 300% have been observed between ostensibly identical regenerators.

(4) Because of the size and shape of flow passages through stacked wire screens, the ratio of pressure drop losses to heat transfer effectiveness is relatively high in stacked screen regenerators.

(5) The cut ends of the wires in the screens are sharp, and it is impossible to completely immobilize the regenerator in its housing. As a result, the edges of the screen abrade the housing, creating debris that clogs passages and damages moving parts.

(6) Stacked screens are made of very fine mesh wire cloth, which is expensive to weave and sensitive to clogging.

(7) Before they are stacked, the screens must be cut with great precision and individually cleaned.

(8) Because the screens are very thin, hundreds of screens must be stacked to achieve the necessary regenerator length, requiring a large quantity of wire cloth.

(9) Assembly of hundreds of delicate screens in a regenerator housing is a tedious, time-consuming task for which no substitute for human labor has been found.

This invention relates to regenerative heat exchangers, specifically for cryocoolers, gas cycle heat engines, refrigerators and heat pumps.

At temperatures above about 50 K., stainless steel woven wire screen regenerators have been accepted as standard. However, regenerator theory indicates that the best geometrical configuration for a regenerator in terms of heat transfer and pressure drop is a parallel plate arrangement. (W. M. Kays and A. L. London, Compact Heat Exchangers, McGraw-Hill, New York, 1984; J. P. Holman, Heat Transfer, McGraw-Hill, New York, 1986; G. Walker, Cryocoolers, Plenum, N.Y., 1983). FIG. 3 from Radebaugh and Louie (R. Radebaugh and B. Louie, Proceedings of the Third Cryocooler Conference, NBS Special Publication 698, U.S. Government Printing Office, Washington, D.C. 1985, p. 177) shows that parallel plates with extremely small clearance are superior to stacked screen by a ratio of about 5 to 1 in terms of heat transfer. This prior work demonstrates that the highest heat transfer rate for a specified flow rate and pressure drop was thought to be developed with a parallel plate configuration.

U.S. Pat. No. 4,619,112 issued Oct. 28, 1986, discloses a spiral winding of a flat plate and a corrugated plate for a regenerator that seems to follow the above teachings by using the corrugations to obtain uniform channels of fluid flow with a large spacing between corrugations, because "the channel width uniformity is interrupted by the corrugations 1002 and deviations from channel width uniformity lowers the efficiency of the channel, the spacing between the corrugations must be large (e.g.) a factor of 5 to 6 or greater) in relation to height of the corrugations in order to maintain a high channel efficiency".

Although the theoretical superiority of parallel plate arrangements was known, regenerators continued to be built with stacked screens or packed spheres because nobody knew (W. Rawlins, K. D. Timmerhaus, R. Radebaugh, Measurement of the performance of spiral wound polyamide regenerator in pulse tube refrigerator, Advances in Cryogenics Engineering, Vol. 37, Plenum, N.Y. 1992, pp. 947–953) of a practical way to achieve a parallel plate regenerator. One major problem is heat conduction parallel to the fluid flow. Another problem is unevenly distributing flow among a series of channels between multiple parallel plates.

The concept of etching microchannels on a surface and capping them with a second, smooth surface, has been discussed in a number of publications. Pressure drop and heat transfer characteristics have been obtained for continuous (vs. alternating) flow in glass microchannels. (Peiui Wu and W. A. Little, Measurement of friction factors for the flow of gases in very fine channels used for microminiature refrigerators, Cryogenics, May 1983 pp. 273–277; Peiyi Wu and W. A. Little, Measurement of the heat transfer characteristics of gas flow in fine channel heat exchangers used for microminiature refrigerators, Cryogenics, August 1984, pp. 415–420).

Regenerative gas cycle machines are promising alternatives to a variety of successful technologies. They are currently used primarily as cryocoolers in low temperature refrigeration applications. However, gas cycle refrigerators show promise as replacements for CFC refrigerators currently in use for food preservation. Where the rejected heat is useful, gas cycle machines can be used as heat pumps. Gas cycle engines offer certain advantages over internal combustion engines and other types of heat engines.

In most kinds of service, regenerative gas cycle machines are competitive on efficiency grounds. However, the margin is small and only efficient, reliable, inexpensive gas cycle machines will be able to compete with other alternative systems. All of those gas cycle machines rely upon regenerators, which represent a major cost as well as a major source of inefficiency in conventionally-designed gas cycle machines.

The purpose of regenerators is to absorb heat while a fluid flows through the regenerator in one direction and release heat to the fluid when it flows through the regenerator in the opposite direction. Regenerators also act as obstructions to the flow of the fluids passing through them, and the resulting fluid friction reduces the efficiency of the machines in which they are employed. Design of regenerators to provide maximum heat transfer relative to fluid friction losses depends upon precise control of the internal geometry of the regenerator matrix.

In gas cycle machines, fluid is alternately compressed and expanded in a thermodynamic cycle. Compression ratio is an important factor in performance, and regenerators must be designed to provide the correct amount of void volume relative to volumes swept by pistons and displacers.

A traditional method of fabricating regenerators is to cut many layers of fine gauge metal wire cloth and stack those layers in a cylindrical housing to form a porous matrix. With stacked wire screens, regenerators are about 30% wire volume and 70% void volume with relatively minor variations from that relationship. Because it is impossible to control the exact position of successive layers of wire screens relative to each other, wire screen regenerators have a highly variable permeability, which makes it difficult to achieve reliable performance. Moreover, regenerators fabricated in this manner are expensive, partly due to the cost of the materials and partly due to the cost of cutting the screens and stacking them.

Beds of packed spheres are another possible alternative. Spheres of equal size pack to a density of about 60%, leaving 40% void volume between the spheres. While that method of regenerator construction avoids some of the expense of cutting and stacking screens, the spheres must be contained in some manner, usually by one or more layers of screen. In packed-sphere regenerators, heat conduction is approximately equal in all directions, which is not optimal. As with stacked screens, the ratio of solid volume to void volume is not adjustable beyond a relatively narrow range.

Other approaches to regenerator construction include felt-like materials fabricated from random wires of metal. These materials also have inherent variability that makes their geometry, and thus their performance, unpredictable. Small particles of wire may be created in the felting process; if dislodged into the stream of fluid passing through the regenerator, they can work their way into the fine clearances between pistons and cylinders, seriously damaging the machine.

Other methods of regenerator construction, such as metal and plastic foam, have been proposed. Foam materials suffer some of the same unpredictability of stacked screens and felt materials. They also have the potential to shed small particles into the fluid stream with deleterious consequences. Rolls of metal foil have been proposed as simple, inexpensive regenerators. By dimpling the surface of the foil slightly, it is possible to create rolls in which successive layers are separated from each other by the bumps in the surface, allowing a narrow passage for fluid flow between the layers. This approach suffers from at least two major drawbacks. First, the foil conducts heat well in the direction of the fluid flow but poorly transverse to the direction of fluid flow. That is the reverse of the desired relationship. Second, the foil blocks fluid flow in the direction transverse to the main fluid flow, making it impossible to adjust pressure differences between parallel layers. It is also difficult to mechanically emboss the foil surface in such a way as to create flow passages of accurate, uniform dimension.

U.S. Pat. No. 1,808,921 issued Jun. 19, 1931 discloses a plurality of sheets rolled into a heat exchanger coil core.

U.S. Pat. No. 4,619,112 issued Oct. 28, 1986 discloses a Stirling cycle machine with a coiled and corrugated foil core of a regenerator.

SUMMARY OF THE INVENTION

The present microchannel-microslot (MCMS) regenerator matches the advantages of the stacked screen regenerator while avoiding the disadvantages, and further appears to be contrary to accepted thought with respect to imperforate parallel plate and corrugated plate design.

Some objects and advantages of this invention are to provide compact, efficient regenerators that can be economically customized and fabricated for use in regenerative gas cycle machinery for a wide variety of applications. Those applications include machines employing the Stirling, Vuilleumier, Ericsson, Gifford-McMahon, pulse tube, thermoacoustic and Sibling cycles. This invention solves a number of problems inherent in existing regenerators for these applications.

This invention is a sculpted foil regenerator with precisely accurate passages or grooves of uniform size at each point in the regenerator. It permits controlled variation in regenerator passage size from one end of the regenerator to the other. It permits controlled variation in the ratio of solid volume to void volume over a substantial range. It offers substantially greater heat conduction in the direction transverse to fluid than in the direction of fluid flow. It offers the opportunity for fluid flow transverse to the main direction of flow in order to equalize pressure across an advancing fluid front. It does not shed particles into the fluid stream. This combination of desirable properties is unmatched by any prior regenerator design. Regenerators of this type may be created quickly and inexpensively by the method described below.

This invention is a practical way to achieve the advantages of regenerative flow between parallel plates. Parallel plates with very small clearances between them have been thought to be the theoretically ideal form of regenerator because parallel plates theoretically maximize heat transfer while minimizing losses resulting from fluid friction (i.e. pressure drop). This invention achieves these benefits by overcoming the problems that have heretofore prevented foil regenerators from competing effectively with screens, balls, or other regenerative arrangements.

The foil of this regenerator is perforated with slits arranged normal to the direction of flow. Those slits permit cross-flow between parallel flow passages. Those slits also interrupt the flow at frequent intervals, inhibiting the formation of a boundary layer on the walls of the flow passages. These effects eliminate the problem of the flow seeking different paths for opposite directions of flow. Thus, this regenerator has very high effectiveness.

The foil in this regenerator is wrapped or stacked upon itself with no folds, dimples or spaces to hold the successive layers apart. Instead, the flow passages are sculpted into the surface of the foil by chemical etching or photoetching processes. Sculpting a recessed groove from one edge of the foil to the other, produces a flow passage completely through the roll of foil. The depth of the sculpted passages can be accurately controlled, so that the width and depth of the flow passages can be accurately controlled when the foil is stacked or rolled upon itself. Uniformity of flow passages reduces the tendency of the flow to seek different paths in opposite directions. Comparable accuracy is not possible when layers of foil are spaced by deforming the foil material with dimples or folds.

The slits in the foil of this regenerator are arranged in such a way as to interrupt the conduction of heat in the direction of flow but not in the direction normal to the flow. They are spaced close enough together so that each piece of foil between two slits is essentially isothermal. The temperature gradient from one end of the regenerator to the other is thus a series of small steps between areas of foil, each with a slightly different temperature than that of its neighbors. The connections between these areas are small, and little heat leaks through the regenerator by conduction through the material.

Because the foil for this regenerator can be sculpted by a continuous, automated process of printing and photoetching, the actual manufacture of the regenerator can consist of nothing more than rolling the foil upon a mandrel or upon itself. The roll has great structural integrity and can then be inserted in the cavity prepared for the regenerator with relative ease.

By allowing flow passages of varying cross section from one end to the other, this invention permits regenerators to achieve the optimum combination of regenerator mass and flow velocity at each point along the flow passages, thereby enhancing regenerator effectiveness.

Thermodynamic simulation for microchannel heat exchangers has been developed and verified. (W. A. Little, R. Yaron, C. Fuentes, Design and Operation of a 30K Two-Stage Nitrogen, Neon J-T Cooler, Proceedings of the Seventh International Cryocoolers Conference, 1992).

Surface photoetching technology capable of producing channels 250 μm wide and 25 μm deep in thin stainless steel foil has been developed recently for R.Y. filters. It is a production process. No significant modification of the process is required to generate the patterns for the regenerator of the present invention. The technique has been used in the production of a microchannel J-T (Joule-Thomson) cooler. During the last two years, the fabrication capabilities have been refined from 250 to 100 μm channel width and 100 μm spacing. The maximum etching format was extended from 16 inches to 50 inches in strip length.

Still further objects and advantages will become apparent for a consideration of the ensuing description and drawings.

DETAILED DESCRIPTION

Figure 1:
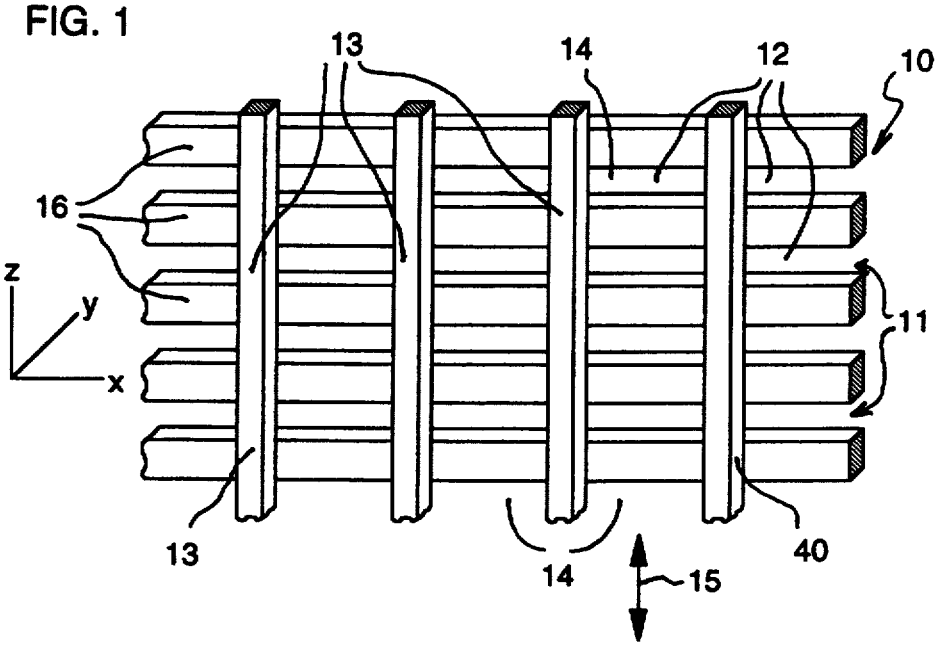
FIG. 1 is a fragmentary perspective view of a section of foil that is perforated and sculpted in accordance with this invention.

The regenerator optimum ratio of solid volume to void volume varies by application. Regenerator matrices with a high proportion of solid to void volume tend to have higher rates of conduction than matrices with larger proportions of void volume. Conduction is undesirable, suggesting that a low proportion of solid to void volume is desirable. As heat transfers into and out of the solid material in the regenerator matrix, the matrix temperature rises and falls. That temperature variation is undesirable. Matrices with a high proportion of solid volume relative to void volume tend to experience less temperature variation, suggesting that a high proportion of solid to void volume is desirable. There is thus conflict to be resolved in selecting the proportions of regenerator solid volume and void volume. That optimal relationship varies from application to application.

For each application, there is an optimal passage size for fluid flowing through the regenerator matrix. Larger passages offer freer fluid flow, but poorer heat transfer. Because they offer less restriction to flow, the larger passages tend to carry a disproportionate amount of fluid, reducing the heat transfer capacity of the regenerator. Thus, uniformity of passage size in the present invention is important in maximizing the efficiency of a regenerator.

Where temperature differences between the ends of the regenerator are large, the optimal passage size varies from one end of the regenerator to the other. Regenerator construction of the present invention allows for desirable end-to-end variation in passage size.

For applications, such as cryocoolers, that require a regenerator with high effectiveness, it is desirable that the flow passing through the regenerator in one direction follow exactly the same path as the flow passing through it in the other direction. If the cold flow favors one path through the regenerator and the warm flow tends to return by a different route, the cold flow will tend to remain cold as it passes through the regenerator in one direction and the warm flow will remain warm as it passes through in the other direction. The regenerator will then be ineffective. As little as 1% variation in flow from one direction to the other can be sufficient to reduce regenerator effectiveness below the level required for cryocooler applications.

Since the flow through the regenerator in each direction will follow the path of least resistance, anything that tends to make the path of least resistance in one direction different from the path of least resistance in the other direction will tend to make the regenerator ineffective. The relationship between resistance to fluid flow (sometimes called fluid friction or pressure drop) and heat transfer is important in determining the path that flowing fluid will follow. Where fluid flows in parallel flow passages between walls that are a different temperature from the fluid and for a distance sufficient for a boundary layer to form, the distribution of the flows will become inherently unstable. That is, some passages will favor flow in one direction and some will favor flow in the other direction. For that reason, regenerators (other than those of the present invention) made of impenetrable parallel surfaces are inherently unable to be effective enough to be used in cryocoolers.

The mechanism that causes instability of flow distribution between unperforated parallel plates (unlike the perforated plates of the present invention) is as follows: The resistance to flow through passages between parallel plates is determined in part by the separation of the plates and in part by the viscosity of the fluid passing between them. The viscosity of the fluid depends upon its temperature. Thus, if the fluid passes through a passage which varies in temperature from end to end, the temperature and viscosity of the fluid will change as heat transfers to or from the fluid. With gaseous fluids, viscosity increases with temperature. Thus, if fluid passes from the cold end of the passage to the warm end, it will become warmer and its viscosity will increase in the boundary layer along the wall. The effect is as if the passage were narrowed, and resistance will increase. However, the heating of the fluid is accompanied by a cooling of the wall. If two parallel passages are slightly dissimilar, and they will always be so in reality, one passage will be cooled slightly less than the other, and the warmer wall of that passage will raise the temperature of the fluid to a higher level. That, in turn, will increase the viscosity of the fluid in that passage, further hampering flow and further decreasing the cooling of the passage walls. Raising the fluid temperature has the effect of decreasing the apparent cross section of the flow passage. Conversely, in the parallel passage, a slightly greater flow of fluid will produce a larger cooling effect in the wall, the fluid will be heated to a lower temperature, its viscosity will be less, and flow will be enhanced. That, in turn, further cools the wall, further lowers viscosity and further eases flow through that passage. The effect is that of a larger flow passage. In the return direction, fluid passes from the warm end of the passages to the cold end. The flow again favors the cooler passage, but the effect of heat transfer is different. The boundary layer is cooled as the fluid passes from warm end to cold end of the passages, but the convective heat transfer coefficient is different when heat is transferred from fluid to wall than when heat is transferred from the wall to the fluid. The apparent increase in cross section of the flow passage is less pronounced as fluid flows from the warm end of the passage to the cold end than was the decrease in apparent cross section of the flow passage as fluid was transferred through the passages in the opposite direction. The preferential effect is thus less pronounced; proportionately less fluid flows in the cooler channel in the return direction and more fluid in the warmer channel.

The effect is partial circulation between passages, with more flow occurring in the cooler passage from cold to warm end than flows from warm end to cold end, and the reverse occurring in the warmer passage. The effect is to make the cooler passage cooler and the warmer passage warmer; the instability tends to persist.

Thus, a solution to the problem may be found by insuring that cross-flow between parallel passages is possible at frequent intervals along the flow path, and that the distance that flows travels between interruptions in parallel walls is not large relative to the separation distance between the parallel walls. Aspect ratios of less than 10 units of flow distance between walls one distance unit apart are desirable. By maintaining short flow distances between interruptions, formation of fully developed boundary layers can be prevented.

Regenerators should allow for the possibility of some flow transverse to the main flow direction to permit equalization of pressure across the whole front of the advancing fluid. To maximize efficiency, the regenerator should conduct as little heat as possible in the direction parallel to fluid flow and conduct as much heat as possible in the direction transverse to the fluid flow so that the temperatures seen by the moving fluid will be as nearly identical as possible across the whole front of the advancing fluid.

It is also essential that the matrix maintain its integrity so that particles that could damage the cylinders and pistons do not break off into the fluid stream.

Regenerative gas cycle machines employ regenerators that store heat energy during one part of their cycle and release it in another part of the cycle. Various materials and various mechanical arrangements have been used to create regenerators. This invention relates to regenerators made of foil For purposes of this disclosure, "foil" means a sheet of metal or other material, including without limitation plastic or ceramic material, in thicknesses less than 1 millimeter (0.001 m, 0.04 inches).

FIG. 1 shows a portion of the core of a regenerator, namely a piece of foil 10 (preferably of metal, metal alloy or metallic compound) with slits 11 formed by through transverse (y direction) passages or grooves 12 between transversely extending (x direction) members 16, and axially extending (z direction) members 13 that together define axial (z direction) fluid flow passages or grooves 14. The main direction of fluid flow 15 (z direction) is along passages 14, past the slits 11. The foil 10 is fabricated by photolithography and etching that are the same as conventionally used in integrated electronic circuit fabrication applied to a strip or sheet of rolled foil of uniform thickness. By such fabrication, the foil is sculpted by photoetching in the y direction or by another process (such as laser or other beam machining) to remove material between the members 13 to a depth accurately controlled by the process. The foil is completely perforated by etching (in the y direction, e.g. after the etching that formed passages 14, the opposite or back surface of the foil is etched to form the slits 11) at the locations of the slits 11. The depth of the main fluid flow passages 14 can be controlled in the photoetching process and the width (in the z direction) of the slits 11 and width (in the x direction) of the passages 14 is determined by the photolithographic mask design imprinted on the back and front surfaces, respectively, of the foil in the photoetching processes.

The single piece homogeneous structure illustrated in FIG. 1, more particularly, may be accomplished by a photoetching process in which the foil is photolithographically printed on the back side with a mask pattern of narrow parallel channels extending in the x direction and normal to the z direction of fluid flow, and in which the foil is printed on the other side (front side in the drawing) with a pattern of channels parallel to the z direction of fluid flow. The foil is then etched from both sides, and when the etching process has reached half way in from each front and back side, through openings in the foil form the through passages 12. The etching process is then halted and the foil is ready to be stacked, either in parallel planar sheets or by rolling it upon itself or upon a mandrel, to create a regenerator core. This method of etching the foil is advantageous because there is no requirement that the mask pattern imprinted on one side of the foil be in register with the mask pattern printed on the other side.

Figure 2:
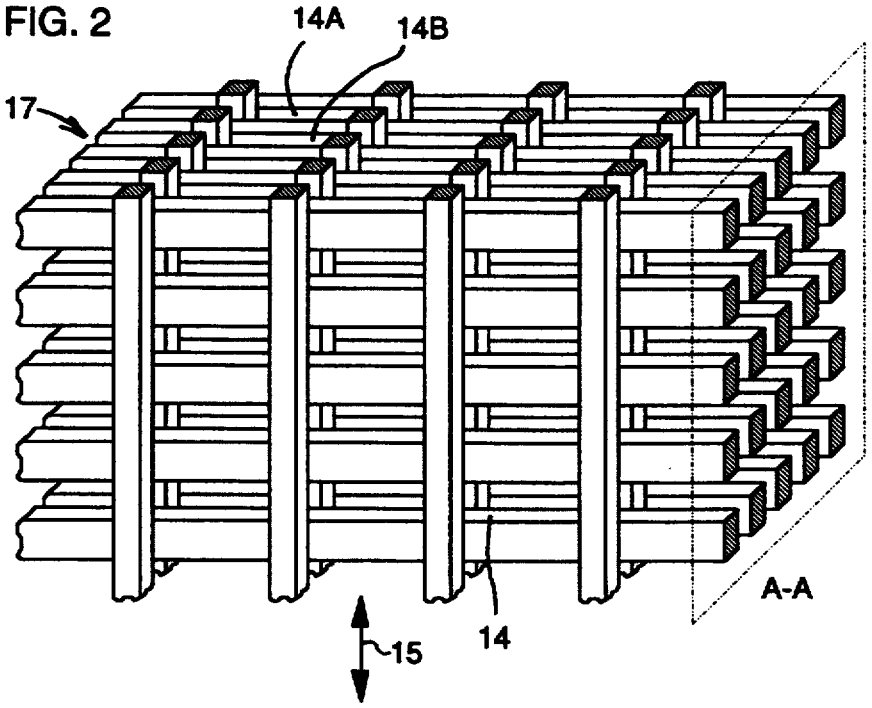
FIG. 2 is a fragmentary perspective view of a regenerator according to the present invention and showing a stack of FIG. 1 or roll of the foil.
Figure 3:
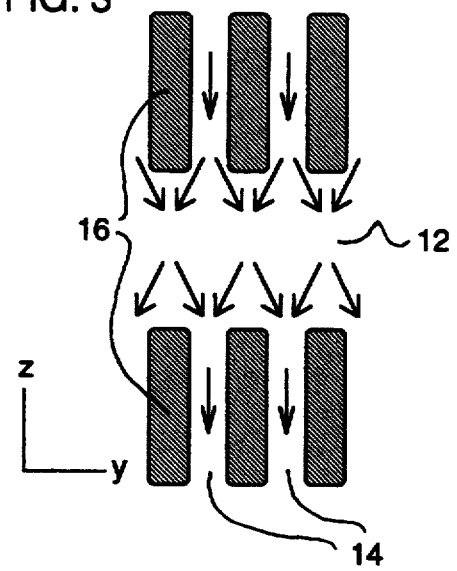
FIG. 3 is a cross-sectional diagram of FIG. 2 along the plane A—A parallel to the vertical direction of flow through the regenerator.

FIG. 2 shows a stack 17 of several layers of the foil 10 that is shown in FIG. 1. Foils 10 are stacked with all of the layers facing in the same direction, that is with the same orientation. Flow through the passages 14 (e.g. in passage 14*a*) is diverted through slits 11 to adjacent passages (e.g. adjacent passage 14*b*) by differences in pressure between those adjacent passages (i.e. 14*a* and 14*b*). By controlling the amount of material removed in sculpting the foils 10 the ratio of solid volume to total volume in a stack 17 of foils can be controlled accurately and uniformly over a wide range. While the members 13 in FIG. 2 are shown as aligned with each other in successive layers of foil, random alignments are equally effective and will occur in a roll of a single foil sheet. Similarly, the slits 11 in FIG. 2 and FIG. 3 are shown as aligned, but they need not be. Relatively good alignment of the slits 11 is the normal circumstance, because the edges of successive layers of foil 10 will usually be in the same plane, and photoetching permits very exact placement of slits 11 relative to the edges of the foil 10. However, precise alignment of slits 11 is not required for the regenerator to function effectively.

FIG. 3 is a schematic depiction of the flow through a stack of foils of the type illustrated in FIG. 2 at Section A—A. Transverse flows in the x and y directions may occur periodically and automatically as necessary to maintain a balanced pressure front across the regenerator at each plane normal to the z direction of the main fluid flow.

Figure 4:
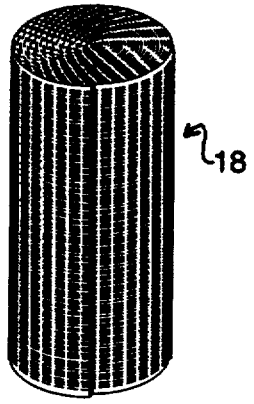
FIG. 4 is a perspective view of the core of the regenerator formed by rolling perforated, sculpted foil upon itself in accordance with this invention.
Figure 14:
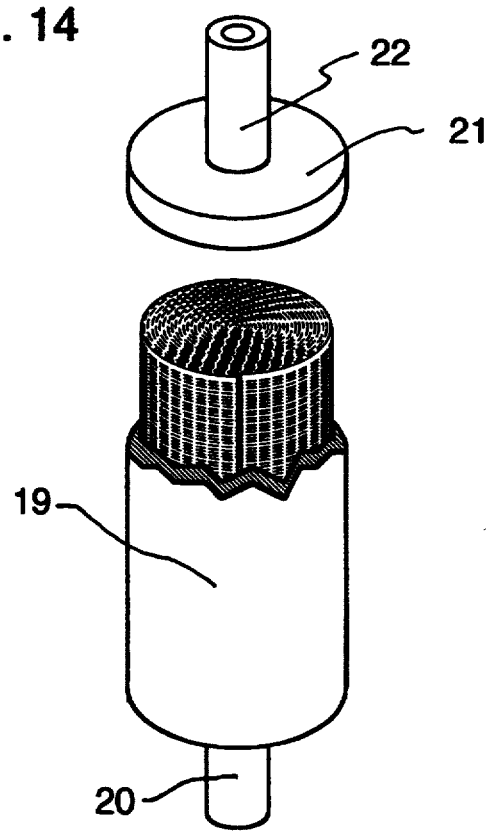
FIG. 14 is an exploded and cut away view of the complete regenerator showing a housing containing the regenerator core of FIG. 4 according to any of the embodiments.

FIG. 4 shows a rolled foil regenerator core 18. Rolling a long strip of foil 10 tightly upon itself is a convenient way of stacking foils upon themselves. The foil is so thin that a portion of the stack in FIG. 4 would appear as in FIG. 2 on a greatly enlarged scale and the curvature would not be apparent. This method of forming a regenerator core 18 is much easier than hand stacking planar screens (prior art) or capturing small granules in a regenerator housing (prior art). Once rolled, the foils may simply be inserted in a cylindrical housing 19 having an end coupling 20 creating one port, which housing is closed by an end cap 21 having a coupling 22 providing a second port, as shown in FIG. 14.

While there will be small discontinuities at the ends (z direction edges) of the foil in the center of the roll and on the outside of the roll, the etched foil is flexible, and tends to fill the void just beyond the end of the strip. If a regenerator contains a large number of layers, the passages created just beyond the ends (edges extending in the z direction) of the rolled strip will not allow enough leakage to significantly impair performance of the regenerator. If necessary, the outer surface of a mandrel and the inner surface of the regenerator housing may be sculpted with a step parallel to the axis (z direction) of the roll and as deep as the thickness of a foil, to permit the foil to maintain contact with the mandrel and housing around their entire circumferences.

In FIG. 4, an example of the regenerator core is a "jelly-roll" fabricated from a single strip of 50 μm thick (y direction) stainless steel foil. Zig-zag microchannels (slits 11, passages 14) 25 μm deep (y direction), are photoetched in such a way as to allow optimum fluid flow through the roll from end to end (top to bottom in the drawing). The foil inner z direction edge is rolled to a zero core radius, preferably, by cold-rolling of the foil between a soft bed and a stationary sharp wedge. Micro-spot welding fixes the outer z direction edge. The members 16 forming the micro slots (slits 11, passages 14) serve as peripheral washers between the regenerator core 18 and its housing 19. The foil is perforated with many rows of microslots or slits 11 that are, oriented transversely to the z direction of fluid flow (i.e., axial direction). The z direction is also the main direction of heat conduction as shown. These slits 11 pass completely through the foil and interrupt axial (z direction) heat conduction through the roll 18, except at the members 13 between slits 11. The rows of slits are staggered relative to each other in the roll of FIG. 4 so that the passages 12 do not line up in the y direction, that is adjacent passages 12 that are in adjacent foil layers are offset in the x direction, which lengthens the conduction path through the foil. The overall effect is to reduce axial heat transfer of the present invention to approximately the same level as in prior art stacked screens.

Because the fluid flow passages 12, 14 are etched in the foil with great precision and regularity, pressure drop losses are minimized. Because fluid flow is in contact with the walls of the etched passages at all points, the full surface area of the passages is available for heat transfer. Because the etched passages 12, 14, and the walls of members 13, 16 that separate them, are very small, substantially all of the mass of the matrix is within the penetration depth of heat transfer during a cycle and therefore participates fully in the regenerative process. The zig-zag pattern of the flow passages 12, 14 breaks up boundary layers at each turn, improving heat transfer.

With the etched foil technique of the above example, a specific surface area of 40,000 $m^2/m^3$, a 25 $\mu m$ hydraulic diameter, and a 0.33 fill factor are attainable. Those values are all comparable to prior art woven stainless steel stacked screens. However, because the flow passages are uniform, clogging of the foil regenerator of the present invention is much less likely than with the stacked screens of the prior art. Because the roll of the present invention offers no sharp wire-ends like the prior art stacked screen to abrade the housing, the present structure does not generate contaminating particles like the prior art.

Overall inefficiency of the wrapped-foil regenerator of the present invention is projected to be less than half of the inefficiency currently obtained using prior stainless steel 25 $\mu m$ wire screen regenerators. With the improvement in efficiency comes a major reduction in fabrication cost. The up-front expense is the generation of the etching mask patterns to be provided on the foil, which generation is accomplished with computer graphics techniques. Once the mask pattern is made, the process of etching is automated. The process of rolling the foil is simple, straightforward and lends itself to being performed by machine.

Figure 5A:
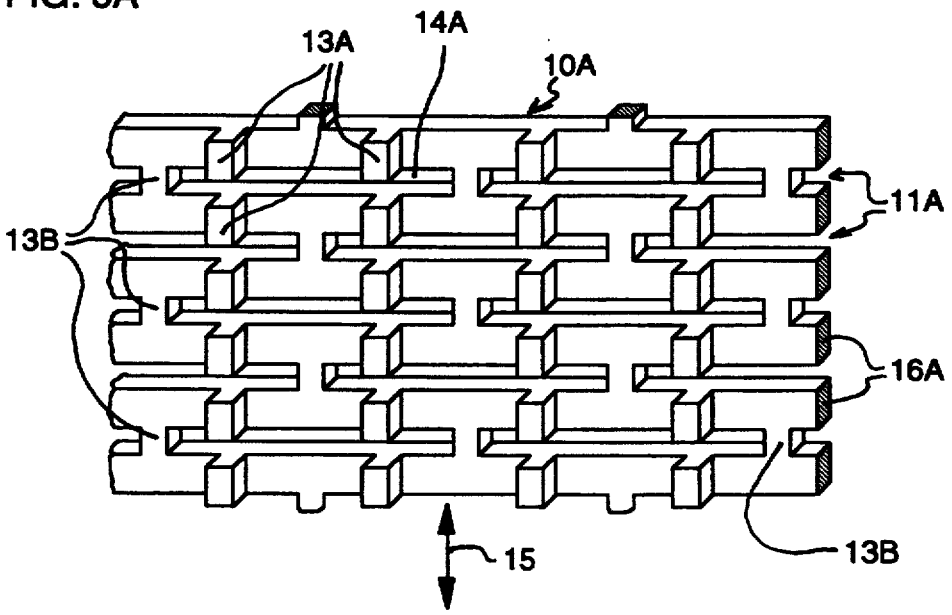
FIG. 5 is a perspective view of a section of a second embodiment of foil; 5A shows a foil that is perforated and sculpted similar to FIG. 1; 5B shows a foil that is perforated and corrugated.
Figure 5B:
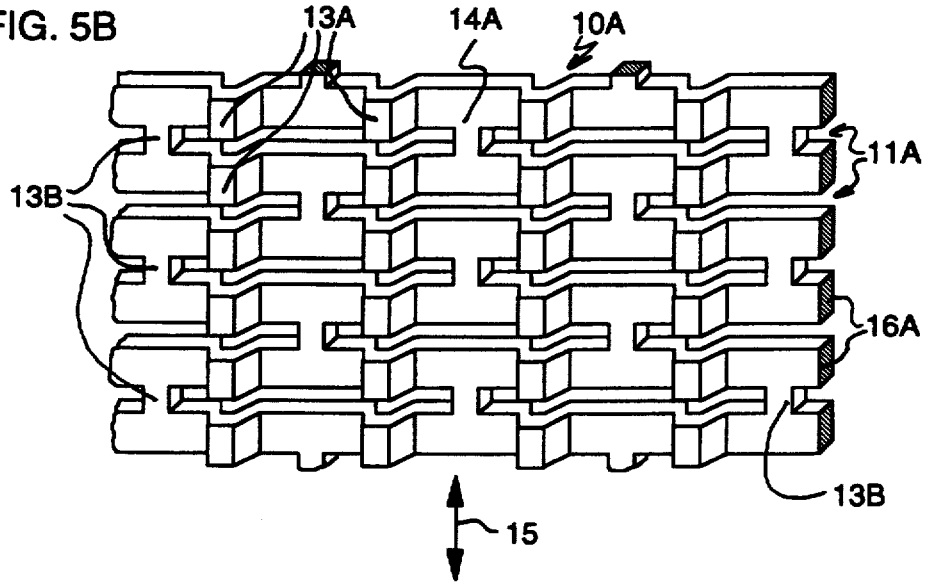

FIG. 5 illustrates an alternate pattern in which foil may be sculpted by the above-mentioned processes. Slits 11A normal to the main z direction 15 of fluid flow are printed and etched from one side (the back side) of the foil. The rows of slits 11 between members 16A are staggered so that the heat conduction path through the members 13B, 16A of the foil 10A must follow a zig-zag path that is significantly longer than the z direction distance from one end of the regenerator to the other. The other side (front) of the foil is etched in a pattern that leaves members 13A between passages 14A parallel to the z direction of main fluid flow and members 13B between slits 11A. This pattern requires that the patterns of photoresist used in the photoetching process be kept in register between the two sides of the foil. Those skilled in the photoetching art know how to do that In FIG. 5A, the portions of the foil that are not etched remain at the full thickness of the foil, creating lands 13A that hold the flow passages 14A open when the foils are stacked or rolled. An alternate method of creating a similar result is to etch slits completely through the foil and to create the lands by deforming the foil as by dimpling or corrugating it. FIG. 5B shows a corrugated foil 10A perforated by slits 11A and deformed by corrugations 13A. By controlling the height of the dimples or corrugations, it is possible to vary the fill factor of the regenerator. This alternate method leaves the foil thicker than it would be if the flow channels were etched into its surface, but it is easier to etch slits completely through the foil and then deform the foil than it is to control the depth of channels etched on the surface of the foil. It is not necessary that deformations be in register with the slits; random placement of dimples will effectively separate adjacent layers of foil even if some of the points of some of the dimples fall in slits.

Figure 6:
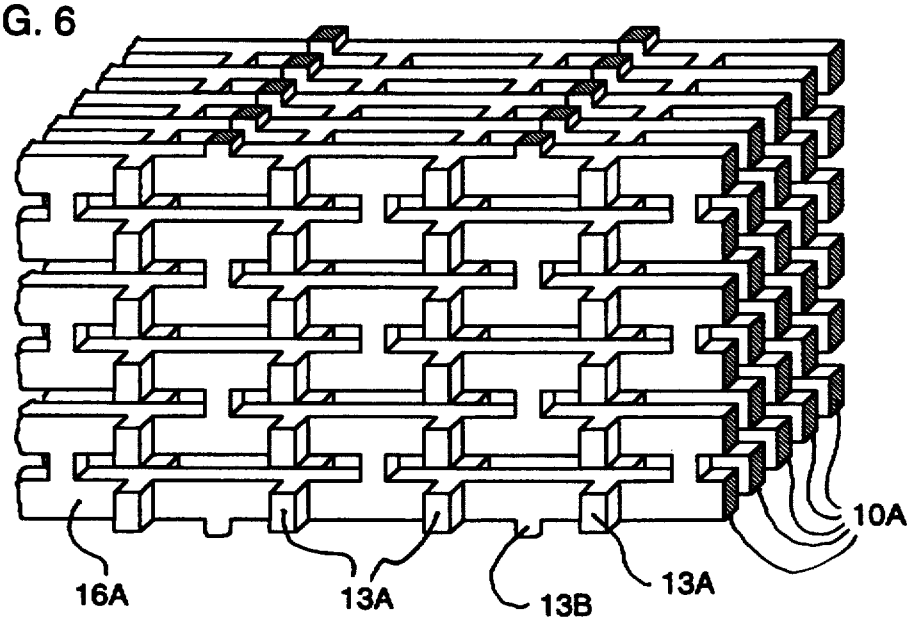
FIG. 6 is a fragmentary perspective view, similar to FIG. 2, but of layers of foil of FIG. 5.

FIG. 6 illustrates a stack of foils 10A prepared in accordance with FIG. 5. To prevent the successive layers of foil 10A from meshing into themselves, it is most desirable that the members 13A be wider than the slits 11A in the z direction. If that condition is met, it is not necessary for either slits 11A or members 13A, 13B to be aligned in any particular manner in successive layers of foil.

Figure 7:
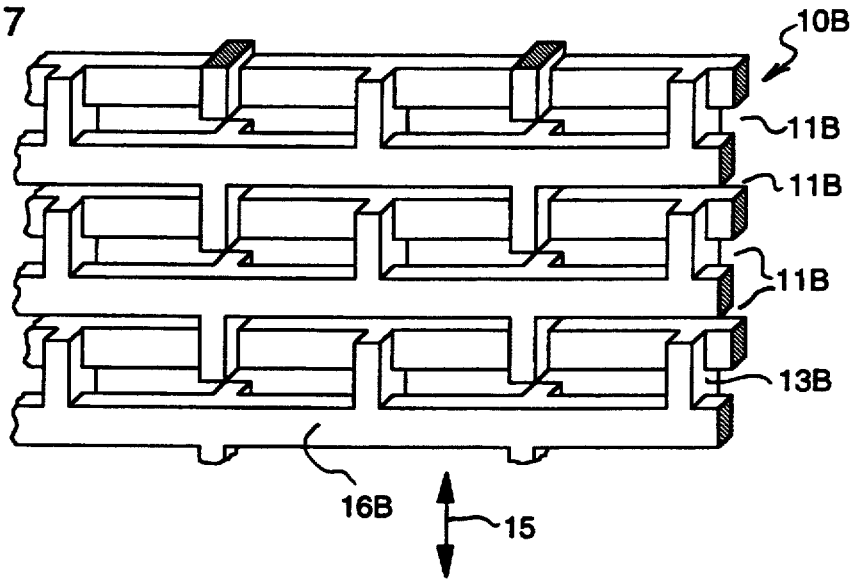
FIG. 7 is a fragmentary perspective view of a section, similar to FIG. 1, of a third embodiment of a foil that is perforated and sculpted.
Figure 8:
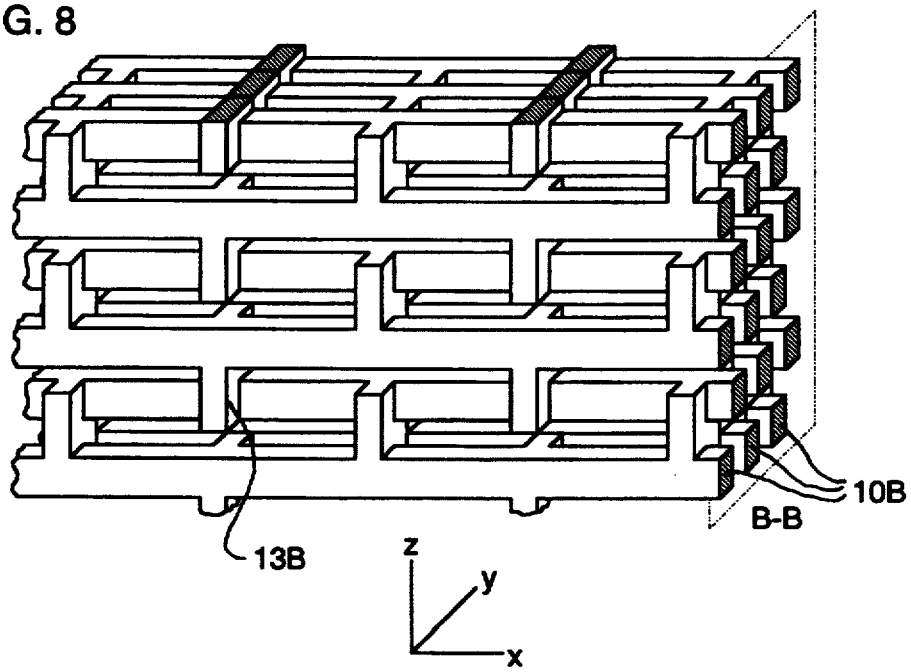
FIG. 8 is a fragmentary perspective view, similar to FIG. 2, but of layers of foil of FIG. 7.
Figure 9:
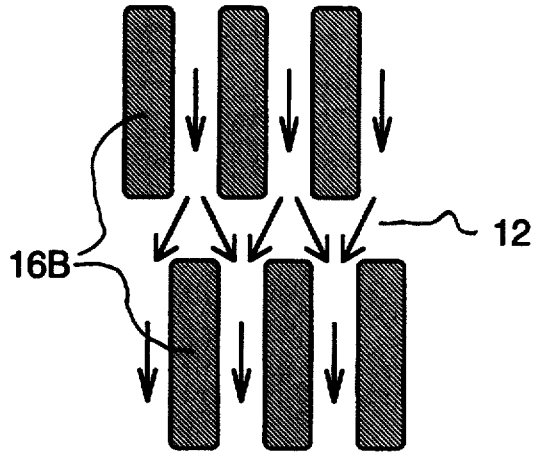
FIG. 9 is a simplified cross-sectional diagram of FIG. 8 taken from plane B—B parallel to the direction of flow through the regenerator.

FIG. 7 illustrates a pattern that may be imprinted and etched upon a foil 10B from both sides, where like numerals refer to like parts. If several layers of foil are stacked in the alignment shown in FIG. 8, the flow path will be as shown in FIG. 9. That path forces the flow to split and recombined, which offers superior heat transfer characteristics. The pattern illustrated in FIG. 7 is desirable because it offers good heat transfer characteristics and because it tolerates misalignment of successive layers of foil because each layer of foil 10B offers independent continuous flow passages from one end of the regenerator core to the other. The pattern illustrated in FIG. 7 requires that the foil be sculpted on both sides by photoetching or some other process as discussed above and that the sculpting be kept in accurate register between the two sides.

Figure 10:
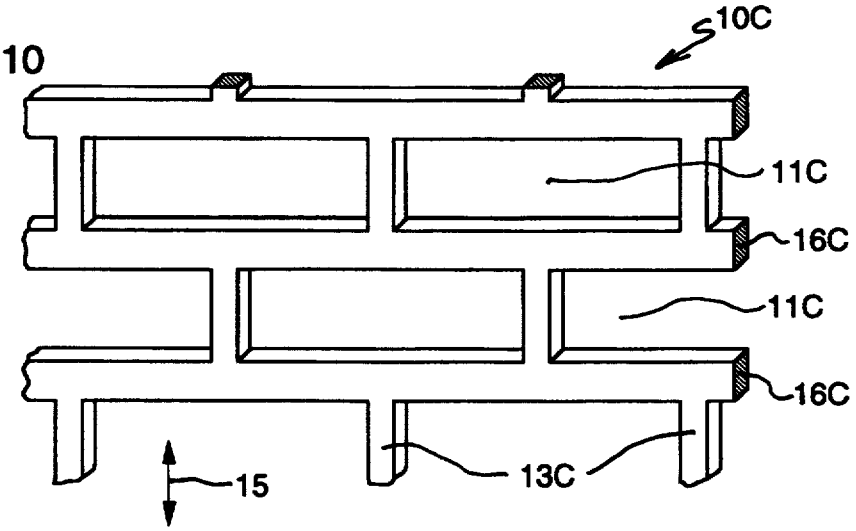
FIG. 10 is a fragmentary perspective view of a section of first foil that is perforated and sculptured according to a fourth embodiment.
Figure 11:
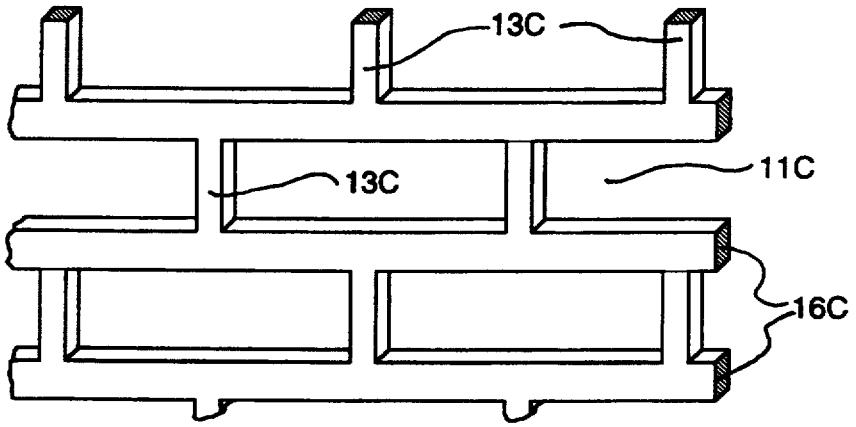
FIG. 11 shows a piece of a second foil that is identical in construction to the first foil in FIG. 10, but in a different position relative to FIG. 10.
Figure 12:
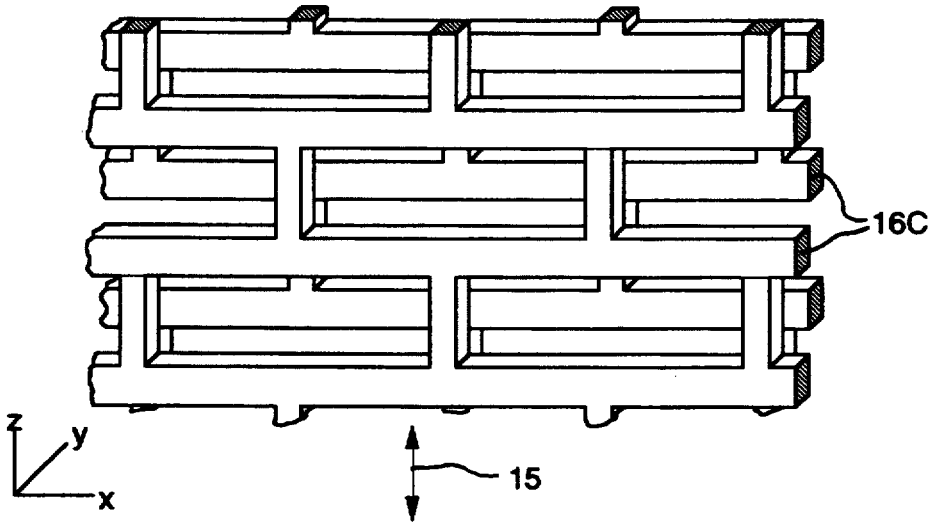
FIG. 12 shows the foil of FIG. 11 stacked on the foil of FIG. 10 to produce the fourth embodiment of the regenerator.

FIG. 10 illustrates a pattern that may be imprinted and etched upon a foil 10C from a single side, eliminating the necessity of controlling etching depth. If two layers of FIGS. 10 and 11 are rolled upon themselves in the alignment as shown in FIG. 12, the flow path will be as shown in FIG. 9. That is, two layers of foil 10C of the type shown in FIG. 10 (FIG. 11 shows the same foil offset in the z direction from the identical foil of FIG. 10) may be combined to produce a combination that is similar in effect and geometric arrangement to a single sheet of foil prepared as shown in FIG. 7. For this approach to work properly, the slits 11C must be wider than the members 16C of foil that remain between the slits 11C, and the members 13C between slits on one sheet of foil must align with the center of the slits 11C in the next sheet. Because the members 13C, 16C of foil surrounding the slits 11C are flexible, the foil will tend to be self-aligning when rolled, with the members 16C that separate the slits 11C in the axial z direction of flow tending to bend where they contact the members 13C that separate the slits in the x direction.

Proper registration can also be obtained by printing two separate foils, one of which is offset relative to the other by the distance required to produce correct registration when the edges of the two foils are aligned. The two foils may then be rolled together, and if their edges are aligned, their slits will be in proper registration.

A regenerator may be fabricated from foil material of uniform thickness appropriate to the application. Generally, for low temperature applications, thinner foil material is required than for high temperature applications such as regenerators for Stirling cycle heat engines. The regenerator foils are sculpted to achieve the optimum ratio of solid material to void volume at each point along the reversing flow path traversed by the fluid that passes back and forth through the regenerator. That is accomplished by adjusting the width of the members 13, 16 and the corresponding widths of the intervening sculpted flow passages 12, 14 as well as by adjusting the depth of the sculpted flow passages and the width and spacing of the slits 11 all to vary, preferably continuously vary, in the z direction of fluid flow.

Figure 13:
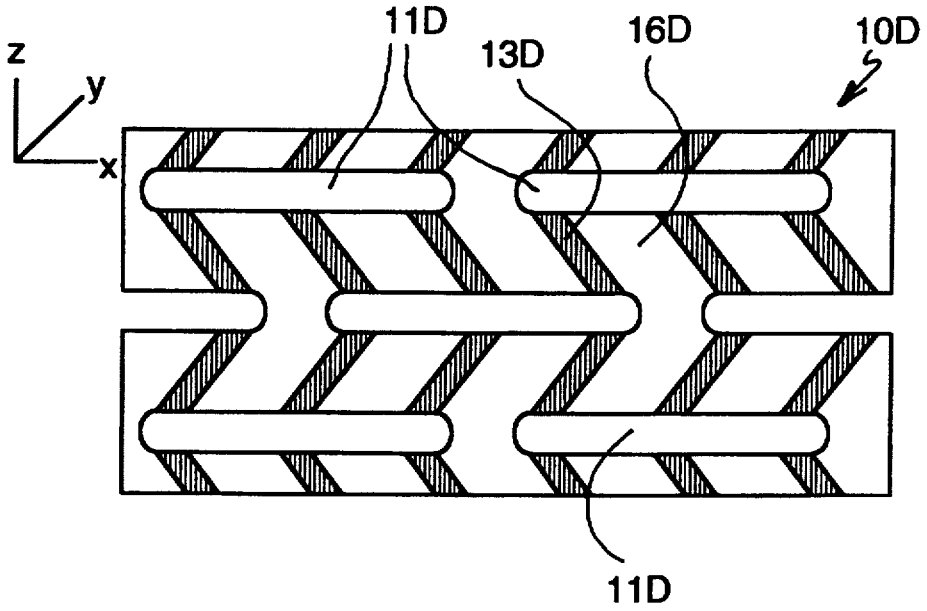
FIG. 13 is a view of the face of a foil of a fifth embodiment.

The foil 10D of FIG. 13 is similar to the foil 10A shown in FIG. 5, except that the members 13D extend angularly in the x direction in addition to the z direction, there are a greater number of the members 13D than the slits 11D, the ends of the slits 11D are rounded, and the dimensions of the members differ, all with respect to comparing FIG. 13 with FIG. 5.

In regenerators constructed from foils of the type illustrated in FIGS. 1–6, as fluid flows back and forth through the regenerator, it travels in many small, separate streams, each traveling an essentially straight path through a sculpted passage 14. Small amounts of fluid move from one sculpted passage 14 to the next through passages 12 in response to small differences in pressure that may arise as a result of small differences in passage dimensions, obstructions caused by lodged debris, or incipient boundary-layer effects tending to alter pressure between adjacent points in adjacent sculpted passages.

Because the geometry of the regenerator is the same for any plane passing through it normal to the main z direction of fluid flow, conditions for uniform distribution of flow in both directions are obtained. Because slits 11 permit flow normal to the main z direction of fluid flow, any differences in pressure in any x-y plane through the regenerator normal to the main flow are automatically adjusted by radial and circumferential flows through the slits. Because the flow through the sculpted passages 14 is generally straight, the flow suffers the minimum attainable fluid friction and thus minimal losses of efficiency through pressure drop.

In regenerators fabricated in accordance with FIGS. 7–12, the flow paths of fluid follow a zig-zag path from one end of the regenerator to the other. The flows split and recombine as they pass laterally through slits, then turn and pass between segments of foil lying between slits.

Figure 17:
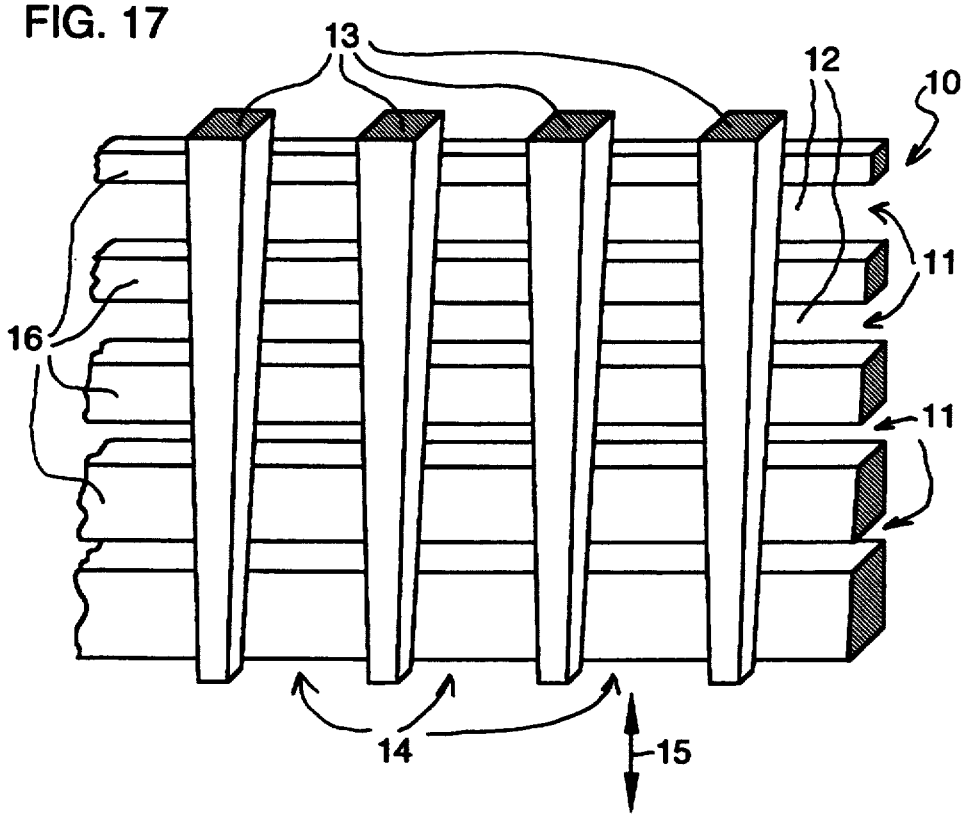
FIG. 17 is a fragmentary perspective view of a section of foil similar to that shown in FIG. 1, perforated and sculpted in accordance with this invention, with continuous variation of dimensions.

FIG. 17 shows a variation of the embodiment illustrated in FIG. 1 in that the dimensions of the transversely-extending (x direction) members 16, the axially-extending (z dimension) members 13, and the spacing between the transversely-extending members 16 all vary continuously from one edge of the foil to the other in the direction of flow 15. As a consequence of these variations in dimensions, the dimensions of the flow passage grooves 14 and the slits 11 between transversely-extending members 16 vary continuously from one edge of the foil to the other in the direction of flow 15 (z direction).

Figure 18:
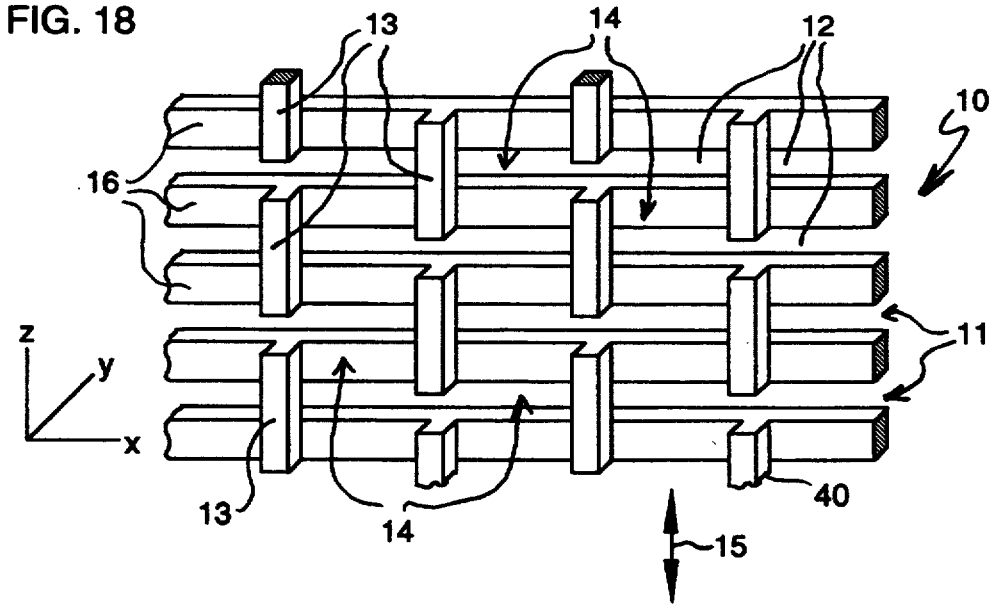
FIG. 18 is a fragmentary perspective view of a section of foil similar to that shown in FIG. 1, perforated and sculpted in accordance with this invention, with variations in groove width.

FIG. 18 shows an embodiment of this invention in which the axially-extending members 13 (z direction) are periodically cut between the transversely extending (x direction) members 16, creating a variation in the width of the flow passage grooves 14 between the axially-extending members 13.

Figure 19:
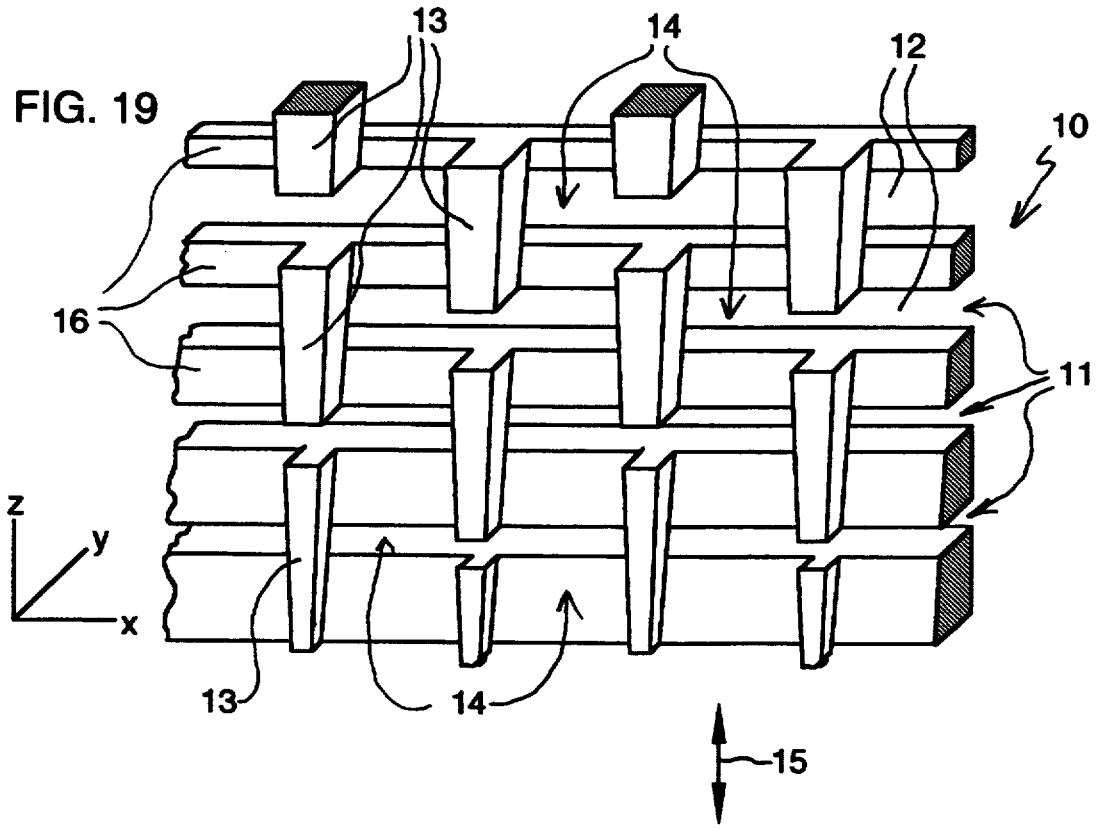
FIG. 19 is a fragmentary perspective view of a section of foil similar to that shown in FIG. 1, perforated and sculpted in accordance with this invention, with variations of dimensions.

FIG. 19 shows a variation of the embodiments illustrated in FIGS. 17 and 18 in that the dimensions of the transversely-extending (x direction) members 16, the axially-extending (z dimension) members 13 and the spacing between the transversely-extending members 16 all vary continuously from one edge of the foil to the other in the direction of flow 15. As a consequence of these variations in dimensions, the dimensions of the flow passage grooves 14 and the slits 11 between transversely-extending members 16 vary continuously from one edge of the foil to the other in the direction of flow 15 (z direction).

Regenerators may be made of foils of various materials, including metals, plastics and ceramics. To be effective, the dimensions of the sculpted and slitted portions of a foil must be uniform and accurate. Although FIGS. 1–12 show all corners and edges of sculpted and perforated areas as sharp and square, that is not essential so long as the basic dimensions (length, depth, width) of sculpted and perforated areas are consistent.

The best method of sculpting the surface of a foil and perforating it with slits depends upon the material. If the material is metal, photoetching is a technique that permits precise control of the depth and contour of sculpted and perforated areas. If the material is plastic, sculpted areas may be embossed by mechanical means. Laser cutting may be used to create perforations. With plastic or ceramic foils, which have inherently low coefficients of thermal conduction, the principal purpose of the perforations is to permit fluid flow transverse to the direction of the main flow.

This invention combines desirable features of a stacked-screen regenerator (i.e. good lateral distribution of flow) and a flat plate regenerator (i.e. low friction flow) without the disadvantages of either. This invention avoids the pressure drop losses of the stacked screen regenerator, and is very much easier to manufacture in quantity than stacked screens; the process of photoetching is much more versatile and more easily automated than the processes of weaving, cutting, cleaning, inspecting, stacking, packing and containing screens.

This invention is superior to regenerators made of solid foil that has been dimpled or folded because it conducts far less heat in the axial direction of fluid flow and its dimensions are far more precise, which is conducive to even distribution of flow. It is also superior to solid foils because it allows some transverse flow, insuring the even distribution of flow in both directions through all parts of the regenerator.

Regenerative cycle machinery has been commercially successful primarily in low temperature refrigeration applications. Those applications have been largely limited to military and medical uses where cost is not a major concern. Much wider usage would be possible if costs of production could be reduced. This invention offers a cheaper, easier way to make regenerators that surpass existing regenerators in performance and thermodynamic flexibility.

Figure 15:
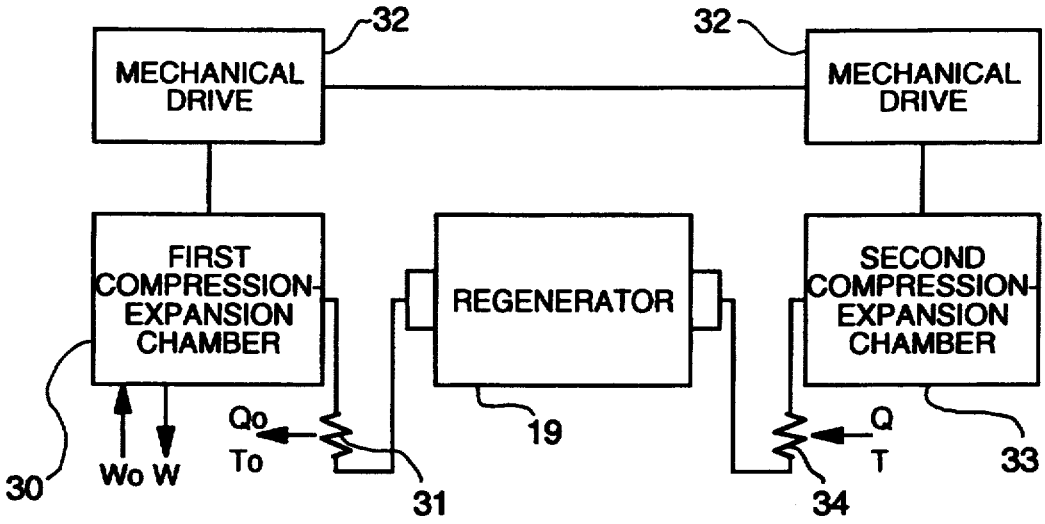
FIG. 15 is a diagram of a Stirling cycle machine employing the regenerator of FIG. 14.

FIG. 15 is a diagram of a Stirling cycle machine employing the regenerator 19 of the present invention. A first compression expansion chamber 30 has a piston receiving work Wo from an external source during the piston upstroke and generating work W during the piston down stroke. When operating as a refrigerator, the net cycle input work is Wo minus W. A cooler 31 rejects heat Qo at temperature To from the working fluid to the surroundings. A displacer or mechanical drive 32 mechanically couples the piston of the first expansion-compression chamber 30, but operating out of phase with it, displaces fluid between the ambient temperature compression space and the low temperature compression space, and includes a second compression expansion chamber 33. The regenerator or regenerative heat exchanger 19 acts as a thermodynamic sponge receiving heat from the working fluid when the fluid is passing from the ambient to low-temperature region. The regenerator 19 releases heat to the working fluid when the fluid is passing back from the low to the ambient temperature region. A freezer 34 receives heat Q or abstracts it from the surroundings at low temperature T. For this particular Stirling machine, refrigeration is the output.

Figure 16:
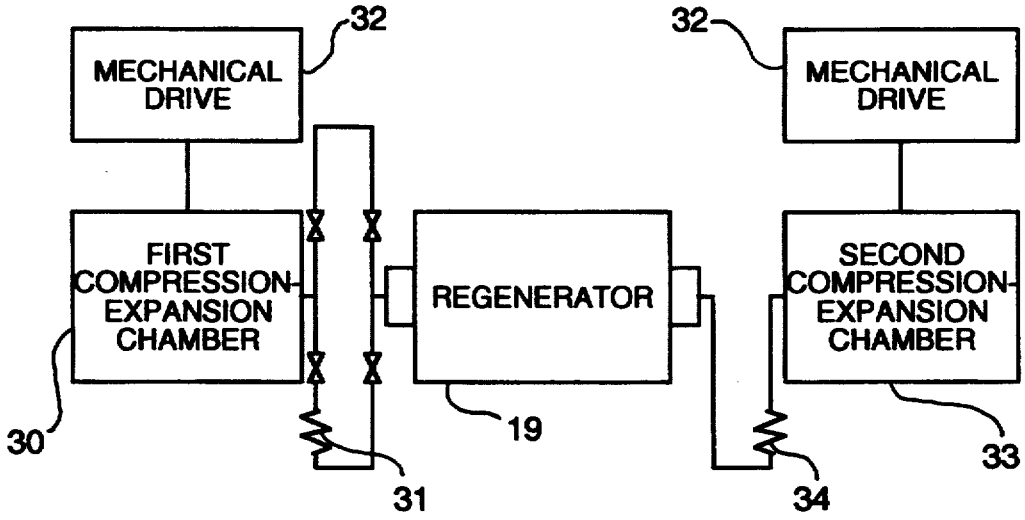
FIG. 16 is a diagram of a Gifford-McMahon machine employing the regenerator of FIG. 14.

FIG. 16 is a simplified diagram of a Gifford-McMahon Cycle machine employing the regenerator 19 of the present invention. The Gifford-McMahon Cycle machine operates similar to the Solvay machine that could also use the present invention, with a difference that a displacer is used instead of an expansion machine of the Solvay system. The machine of FIG. 16 is quite similar to that of FIG. 15, and like numerals have been applied to like parts. A parallel line and valving has been added to the machine of FIG. 15 in forming the machine of FIG. 16.

Because they can be made with a wide range of void volume ratios, regenerators embodying this invention can be used in a wide range of applications, including regenerative gas cycle machines operating at high and low pressure ratios and high and low temperature ratios.

Because they closely approach the theoretically desirable parallel-plate design, regenerators embodying this invention can be extremely efficient. Because they have slits that permit lateral flow and that interrupt the development of boundary layers, they overcome the problem of maldistributed flow that has prevented parallel-plate regenerators from achieving their theoretical effectiveness.

Although the description above contains many specificities, these should not be construed as limiting the scope of the invention but as merely providing illustrations of some of the presently preferred embodiments of this invention. Thus the scope of the invention should be determined by the appended claims and their legal equivalents, rather than by the examples given.

We claim:

1. In a regenerative cycle machine having a first expansion-compression chamber, and a second compression-expansion chamber, a regenerator heat exchanger for fluid connecting the first expansion-compression chamber and the second compression-expansion chamber, the improvement being in the regenerator, comprising:

a housing having a first inlet/outlet port for the fluid and a second outlet/inlet port for the fluid, and defining a general fluid flow direction of the fluid through the regenerator so that during one portion of a cycle fluid flows from the first compression-expansion chamber through the regenerator to the second expansion-compression chamber and in another portion of the cycle flows from the second compression-expansion chamber through the regenerator to the first compression-expansion chamber;

a regenerator core substantially filling the entire interior of the housing and comprising a stack of adjacent generally parallel foil portions;

each foil portion comprising an integral homogenous one-piece uniform thickness sheet material having a plurality of first grooves generally extending parallel to the general fluid flow direction, and second grooves extending transversely to the general fluid flow direction;

said first and second grooves periodically intersecting each other so as to form a plurality of through fluid passages from one side of each foil portion to the opposite side for equalizing pressure across each foil portion throughout the stack and for breaking up laminar flow and reducing boundary layer thickness along the first grooves.

2. A machine according to claim 1, wherein said grooves are formed by etched surfaces.

3. A machine according to claim 1, wherein said first and second grooves are formed by photolithography etched surfaces.

4. A machine according to claim 1, wherein said first grooves are perpendicular to said second grooves and said second grooves are perpendicular to the general fluid flow direction.

5. A machine according to claim 1, wherein said first grooves vary in depth from the first port to the second port continuously.

6. A machine according to claim 1, wherein said first and second grooves of each foil portion are aligned with the first and second grooves, respectively of an adjacent foil portion.

7. A machine according to claim 1, wherein said first and second grooves of each foil portion are mis-aligned with the first and second grooves, respectively of an adjacent foil portion.

8. A machine according to claim 1, wherein the second grooves adjacent to each other in the direction of fluid flow in each foil portion are staggered to be misaligned.

9. A machine according to claim 1, wherein said first grooves are discontinuous in the general fluid flow direction.

10. A machine according to claim 1, wherein said first grooves are in opposite faces of each foil portion, discontinuous in the general fluid flow direction and misaligned in the transverse direction;

wherein said second grooves are in each surface of each foil portion, discontinuous in the general fluid flow direction and transversely misaligned; and said first and second grooves are so oriented that fluid flowing in the general fluid flow direction in a first one of the first grooves in one surface of a foil portion flows transversely through the foil portion to thereafter flow in the fluid flow direction in another first groove in the opposite surface of the foil portion, so that fluid flowing in the fluid flow direction in one groove of the first grooves was passed transversely through a foil portion by passing through one of the second grooves before passing along another of the first grooves in the fluid flow direction to balance pressure across each foil portion.

11. A machine according to claim 1, wherein each of the second grooves communicates directly with a plurality of the first grooves on one face of each foil portion.

12. A machine according to claim 1, wherein adjacent foil portions in the transverse direction are substantially identical and misaligned.

13. A machine according to claim 1, wherein said first grooves angularly extend in both the fluid flow direction and transverse to the fluid flow direction.

14. A machine according to claim 1, wherein the width of the second grooves in the direction of fluid flow is less than 6 times the maximum thickness of each foil portion.

15. A machine according to claim 1, wherein the width, as measured perpendicular to the general fluid flow direction, of the first grooves varies continuously from the first port to the second port.

16. A machine according to claim 1, wherein the width of the second grooves, for each foil portion and as measured in the general fluid flow direction, varies continuously from the first port to the second port.

17. A machine according to claim 1, wherein the dimensions of the second grooves vary continuously from the first port to the second port.

18. A machine according to claim 1, wherein the maximum thickness of each foil portion is less than 1 mm.

19. A machine according to claim 1, wherein the stack is formed as at least one roll of heat transfer solid foil spirally rolled about an axis generally parallel to the fluid flow direction.

20. A machine according to claim 1, wherein the thickness of each foil portion is less than 100 μm.

21. A regenerative heat exchanger, comprising:

a housing having a first inlet/outlet port for fluid and a second outlet/inlet port for the fluid, and defining a general fluid flow direction of the fluid through the regenerator;

a regenerator core substantially filling the entire interior of the housing and comprising a stack of adjacent generally parallel foil portions;

each foil portion comprising an integral homogenous one-piece uniform thickness sheet material having a plurality of first grooves generally extending parallel to the general fluid flow direction, and second grooves extending transversely generally perpendicular to the general fluid flow direction;

said first and second grooves periodically intersecting each other so as to form a plurality of through fluid passages from one side of each foil portion to the opposite side for equalizing pressure across each foil portion throughout the stack and for breaking up laminar flow and reducing boundary layer thickness along the first grooves.

22. A regenerative heat exchanger according to claim 21, wherein said grooves are formed by etched surfaces.

23. A regenerative heat exchanger according to claim 21, wherein said first and second grooves are formed by photolithography etched surfaces.

24. A regenerative heat exchanger according to claim 21, wherein said first grooves are perpendicular to said second grooves and said second grooves are perpendicular to the general fluid flow direction.

25. A regenerative heat exchanger according to claim 21, wherein said first grooves vary in depth from the first port to the second port continuously.

26. A regenerative heat exchanger according to claim 21, wherein said first and second grooves of each foil portion are aligned with the first and second grooves, respectively of an adjacent foil portion.

27. A regenerative heat exchanger according to claim 21, wherein said first and second grooves of each foil portion are mis-aligned with the first and second grooves, respectively of an adjacent foil portion.

28. A regenerative heat exchanger according to claim 21, wherein the second grooves adjacent to each other in the direction of fluid flow in each foil portion are staggered to be mis-aligned.

29. A regenerative heat exchanger according to claim 21, wherein said first grooves are discontinuous in the general fluid flow direction.

30. A regenerative heat exchanger according to claim 21, wherein said first grooves are in opposite faces of the each foil portion, discontinuous in the general fluid flow direction and misaligned in the transverse direction;

wherein said second grooves are in each surface of each foil portion, discontinuous in the general fluid flow direction and transversely misaligned; and said first and second grooves are so oriented that fluid flowing in the general fluid flow direction in a first one of the first grooves in one surface of a foil portion flows transversely through the foil portion to thereafter flow in the fluid flow direction in another fluid flow direction in another first groove in the opposite surface of the foil portion, so that fluid flowing in the fluid flow direction in one groove of the first grooves was passed transversely through a foil portion by passing through one of the second grooves before passing along another of the first grooves in the fluid flow direction to balance pressure across each foil portion.

31. A regenerative heat exchanger according to claim 21, wherein each of the second grooves communicates directly with a plurality of the first grooves on one face of each foil portion.

32. A regenerative heat exchanger according to claim 21, wherein adjacent foil portions in the transverse direction are substantially identical and misaligned.

33. A regenerative heat exchanger according to claim 21, wherein said first grooves angularly extend in both the fluid flow direction and transverse to the fluid flow direction.

34. A regenerative heat exchanger according to claim 21, wherein the width of the second grooves in the direction of fluid flow is less than 6 times the maximum thickness of each foil portion.

35. A regenerative heat exchanger according to claim 21, wherein the width, as measured perpendicular to the general fluid flow direction, of the first grooves varies continuously from the first port to the second port.

36. A regenerative heat exchanger according to claim 21, wherein the width of the second grooves, for each foil portion and as measured in the general fluid flow direction, varies continuously from the first port to the second port.

37. A regenerative heat exchanger according to claim 21, wherein the dimensions of the second grooves vary continuously from the first port to the second port.

38. A regenerative heat exchanger according to claim 21, wherein the maximum thickness of each foil portion is less than 1 mm.

39. A regenerative heat exchanger according to claim 21, wherein the stack is formed as at least one roll of heat transfer solid foil spirally rolled about an axis generally parallel to the fluid flow direction.

40. A regenerative heat exchanger according to claim 21, wherein the thickness of each foil portion is less than 100 μm.

41. A regenerative heat exchanger for fluid, comprising:

a housing having a first inlet/outlet port for fluid and a second outlet/inlet port for the fluid, and defining a general fluid flow direction of the fluid through the regenerator;

a regenerator core substantially filling the entire interior of the housing and comprising at least one roll of heat transfer solid foil spirally rolled about an axis generally parallel to the fluid flow direction so as to form a stack of adjacent generally parallel foil portions;

each foil portion comprising an integral homogenous one-piece uniform thickness sheet material having a plurality of etched grooves extending generally parallel to the general fluid flow direction; and said grooves forming a plurality of parallel fluid passages along a surface of each foil portion between said ports, throughout the stack; and said grooves vary in depth from the first port to the second port continuously.

42. A regenerative heat exchanger according to claim 41, wherein the stack is formed as at least one roll of heat transfer solid foil spirally rolled about an axis generally parallel to the fluid flow direction.

43. A regenerative heat exchanger according to claim 42, wherein the thickness of each foil portion is less than 100 μm.

44. A regenerative heat exchanger according to claim 1, wherein the thickness of each foil portion is less than 100 μm.

45. A regenerative heat exchanger, comprising:

a housing having a first inlet/outlet port for the fluid and a second outlet/inlet port for the fluid, and defining a general fluid flow direction of the fluid through the heat exchanger;

a heat exchange core substantially filling the entire interior of the housing and comprising at least one roll of heat transfer solid foil spirally rolled about an axis generally parallel to the general fluid flow direction so as to form a stack of adjacent generally parallel foil portions;

each foil portion comprising an integral homogenous one-piece uniform thickness sheet material having a first face, an opposite second face and a plurality of first passages extending into said first face to reduce thickness of the foil at the first passages and to provide for flow of the fluid generally parallel to the general fluid flow direction, and second passages in the second face to reduce thickness of the foil at the second passages; and said first and second passages periodically intersecting each other so as to form a plurality of through fluid passages from one side of each foil portion to the opposite side for equalizing pressure across each foil portion throughout the stack, for interrupting heat conduction in the foil and for breaking up laminar flow and reducing boundary layer thickness along the first passages.

46. A regenerative heat exchanger according to claim 45, wherein said passages are formed by etched surfaces.

47. A regenerative heat exchanger according to claim 46, wherein said first passages vary in cross section from the first port to the second port continuously.

48. A regenerative heat exchanger according to claim 45, wherein the thickness of each foil portion is less than 100 μm.

49. In a regenerative cycle machine having a regenerator heat exchanger for fluid, the improvement being in the regenerator, comprising:

a housing having a first inlet/outlet port for the fluid and a second outlet/inlet port for the fluid, and defining a general fluid flow direction of the fluid through the regenerator;

a regenerator core substantially filling the entire interior of the housing and comprising at least one roll of heat transfer solid foil spirally rolled about an axis generally parallel to the general fluid flow direction so as to form a stack of adjacent generally parallel foil portions;

each foil portion comprising an integral homogenous one-piece uniform thickness sheet material having a first face, an opposite second face and a plurality of first passages extending into said first face to reduce thickness of the foil at the first passages and to provide for flow of the fluid generally parallel to the general fluid flow direction; and wherein said first passages vary in cross section from the first port to the second port continuously.

50. A machine according to claim 49, wherein the passages have etched walls.

* * * * *